United States Patent [19]

Nation et al.

[11] Patent Number: 4,891,476

[45] Date of Patent: Jan. 2, 1990

[54] INDEX ROTARY SWITCH

[75] Inventors: Melvin S. Nation, Elmhurst; Robert W. Krawczyk, Rolling Meadows, both of Ill.

[73] Assignee: Illinois Tool Works, Inc., Chicago, Ill.

[21] Appl. No.: 191,359

[22] Filed: May 9, 1988

[51] Int. Cl.[4] ..... H01H 19/28

[52] U.S. Cl. ..... 200/11 R; 200/527; 361/400; 439/845

[58] Field of Search ..... 200/11 R, 156, 153 J, 200/11 G, 292, 526, 527; 439/845, 849; 361/400

[56] References Cited

U.S. PATENT DOCUMENTS

| | | | |
|---|---|---|---|
| 1,291,933 | 1/1919 | Kuhn et al. | 439/845 |
| 4,293,751 | 10/1981 | Van Benthuysen et al. | 200/156 |
| 4,417,106 | 11/1983 | Gingerich et al. | 200/5 R |

*Primary Examiner*—A. D. Pellinen
*Assistant Examiner*—Morris Ginsburg
*Attorney, Agent, or Firm*—Schwartz & Weinrieb

[57] ABSTRACT

An index rotary switch including a rotary contact carrier journaled between a pair of thrust bearings solely for rotary motion. A rotary electrical contact including four contacts indexes with a stationary contact array forming an infinite number of ON-OFF positions and forms a redundant constant pressure electrical contact in each ON position.

20 Claims, 4 Drawing Sheets

FIG.1
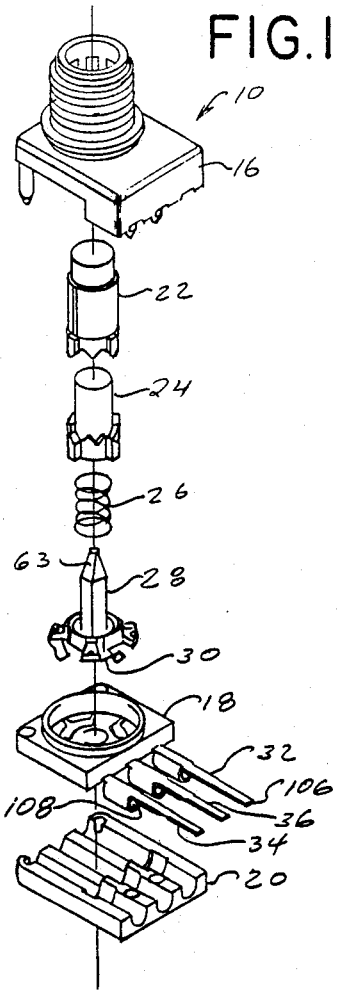
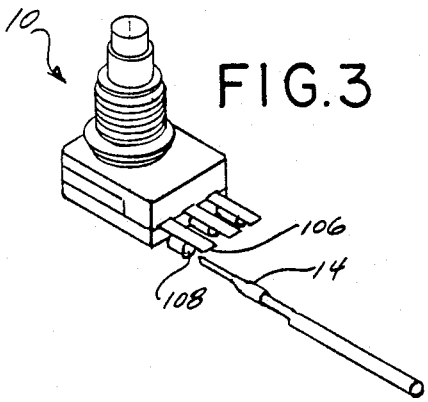
FIG.3
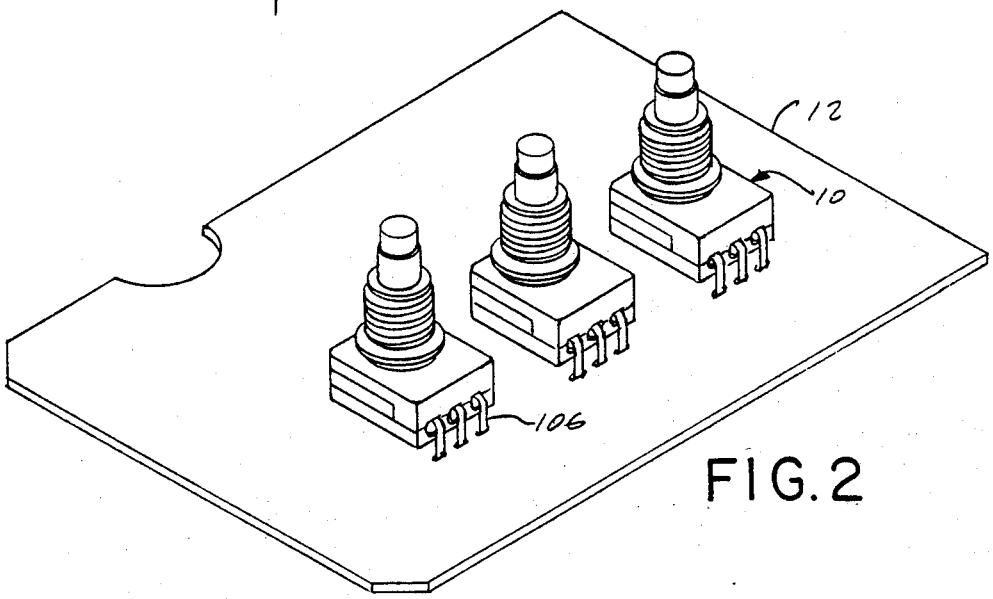
FIG.2

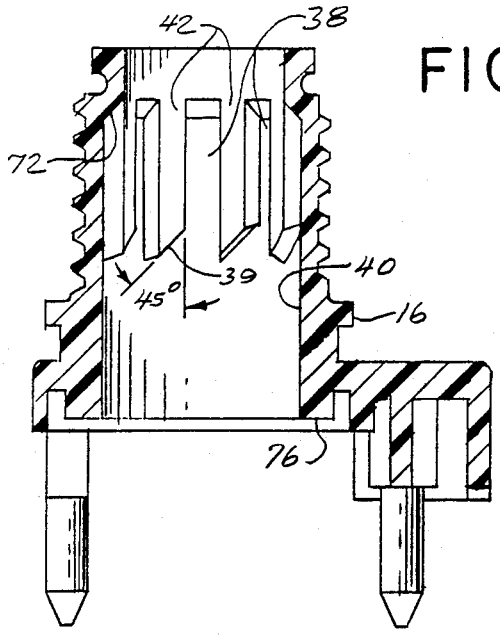
FIG.4
FIG.5
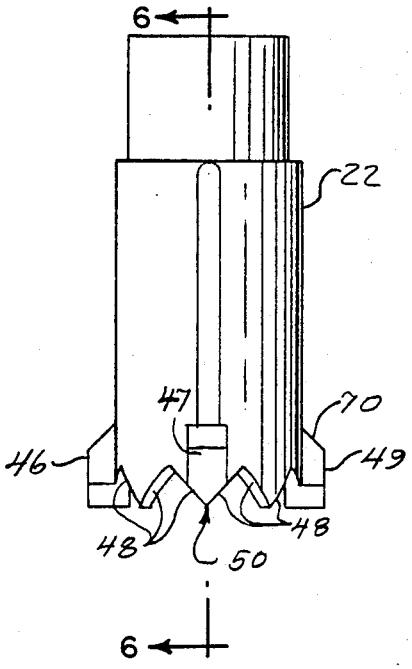
FIG.6
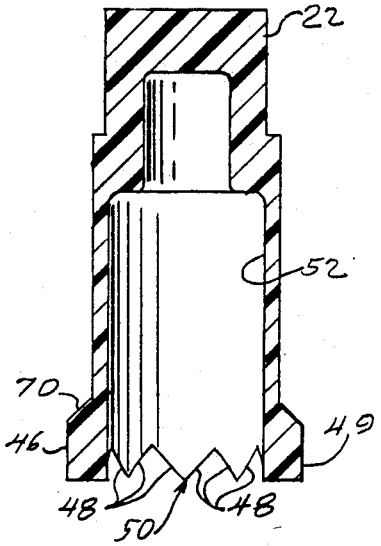

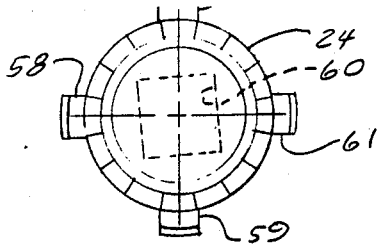
FIG.9
FIG.7
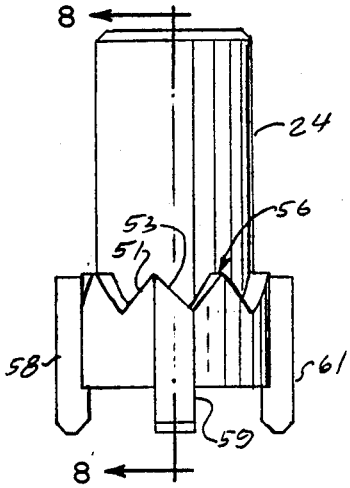
FIG.8
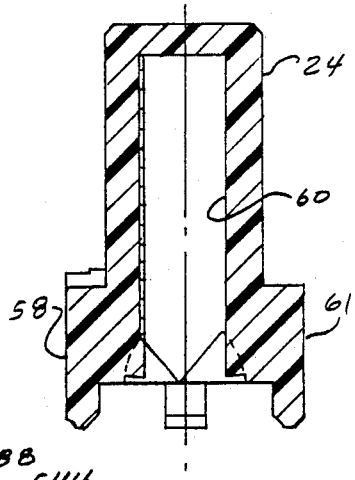
FIG.12
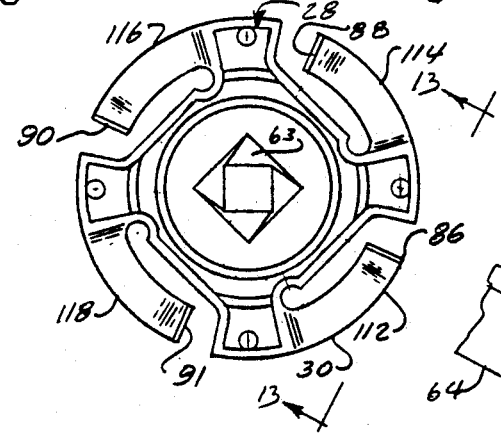
FIG.13
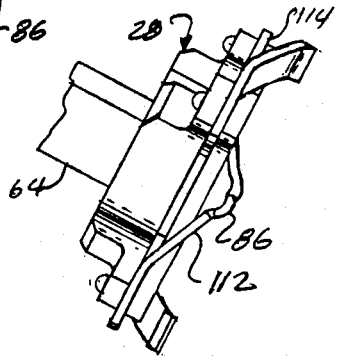
FIG.10
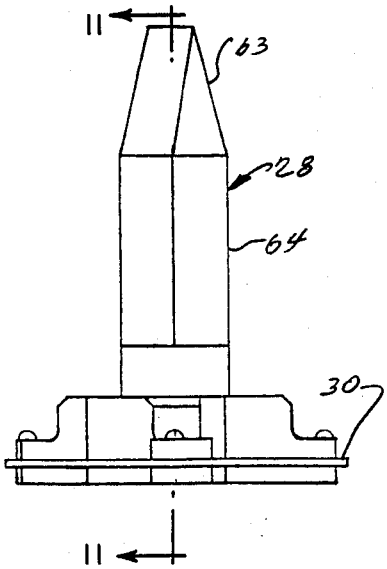
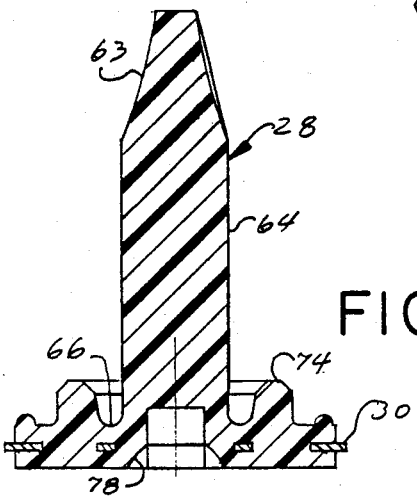
FIG.11

INDEX ROTARY SWITCH

FIELD OF THE INVENTION

This invention relates to an index rotary switch. More particularly, the invention relates to a pushbutton actuated index rotary switch.

BACKGROUND OF THE INVENTION

While not limited thereto, the switch of the present invention is particularly adapted for use in low voltage applications such as, for example in automotive vehicle circuits. Pushbutton indexing-type rotary switches are typically used to control the operation of lights associated with the vehicle such as, for example, overhead, map or other auxiliary lights. Such switches alternately activate and deactivate the circuit to be controlled through successive actuations of a pushbutton causing the switch mechanism to rotate a contact to successively make and break electrical contacts.

While index type rotary switches are known, present switches of this type suffer certain shortcomings principally in regard to short contact life and other operational characteristics. For example, one known index rotary switch utilizes a combination axially reciprocating and rotating contact to make and break contact with stationary contacts. This switch used a point-to-point type contact which is susceptable to arcing and corrosion. Furthermore, the current carrying capacity of this design diminishes its service life due to contact degradation. Still further, even with the contacts in good condition, the current carrying capacity of this known switch is limited by means of the contact area of the single pair of contacts to marginally low levels as established by means of present requirements. Such switch design has also been found to be susceptible to spurious actuation when subjected to vibrations that occur during the operation of automotive vehicles. Also, present switches lack versatility in installation techniques particularly in regard to their lack of provision for alternative mounting upon and connection to circuits upon printed circuit boards and other terminal connections. Such lack of versatility in connection with installation techniques severely limits circuit designs and compromises installation and maintenance costs.

OBJECT OF THE INVENTION

Accordingly, it is the object of this invention to provide for an index rotary switch that has improved operational characteristics, increased useful life over present switches of this type and which is adapted for use in a variety of popular modern installation and electrical connection techniques without modification required to be made to the switch.

SUMMARY OF THE INVENTION

According to the invention, a rotary contact carrier is mounted within a housing between thrust bearings solely for rotary motion and is actuated by means of a pushbutton type actuator mechanism. Advantageously the thrust bearings eliminate any axial loading upon a rotary contact element affixed to the contact carrier by means of an actuator pushbutton return spring.

According to an important feature of the invention, the rotary contact is a preformed resilient contact element which wipingly contacts an array of stationary contacts with a constant amount of pressure.

According to a still further important feature of the invention, the stationary contacts define an infinite number of alternating on and off positions when successively contacted by means of the rotary contact.

According to another very important feature of the invention, the stationary contacts are formed by means of three stationary contact elements. One element defines two spaced apart electrically connected stationary contacts, a second element defines two additional electrically connected spaced apart stationary contacts that are electrically isolated from the two stationary contacts of the first element, and the third stationary contact element defines three additional stationary electrically connected spaced apart contact one of which is located between each of the two electrically connected contacts of the first and second elements and another one of which is disposed between two electrically isolated stationary contacts of the first and second contact elements. The rotary contact includes four contacts which successively, wipingly engage and index with the stationary contacts in a manner defining an infinite number of alternating ON and OFF positions. Timing and positioning of the stationary contacts and rotary contacts provide for redundancy of electrical contact since, in each ON position, two rotary contacts and two stationary contacts are engaged. Advantageously, the redundant electrical contact at least doubles the current carrying capacity of the switch as compared to that of a single contact while the wiping contact engagement reduces arcing and corrosion and further extends contact life.

A still further important feature of the invention provides for each stationary contact element to include a combination printed circuit board connection spade or lug and a female plug type terminal receptacle providing alternative means for connection to an external circuit as a result of mounting the switch directly upon a printed circuit board or connecting the same to common plug type terminal connectors.

BRIEF DESCRIPTION OF THE DRAWINGS

The invention will be better understood after a reading of the following Detailed Description of the Preferred Embodiment in conjunction with the drawings in which:

FIG. 1 is an exploded pictorial view of an index rotary switch according to the present invention showing the relationship of the various switch parts;

FIG. 2 is a pictorial view of the switch according to invention showing the switch alternatively mounted to a printed circuit board;

FIG. 3 is a pictorial view of the switch according to the invention showing an alternative terminal connection for use with a plug type connector;

FIG. 4 is a vertical cross sectional view through the actuator portion of the switch housing showing the details of construction;

FIG. 5 is a side view of the pushbutton plunger showing the details of construction;

FIG. 6 is a vertical cross sectional view of the pushbutton plunger taken along the line 6—6 in FIG. 5 showing the details of construction;

FIG. 7 is a side view of the pushbutton actuator cam follower showing the details of construction;

FIG. 8 is a vertical cross sectional view of the cam follower taken along line 8—8 in FIG. 7 showing additional details of construction;

FIG. 9 is a top view of the cam follower showing additional details of the construction;

FIG. 10 is a side view of the rotary contact carrier showing the details of construction;

FIG. 11 is a vertical cross sectional view of the rotary contact carrier taken along the line 11—11 in FIG. 10;

FIG. 12 is a top view of the rotary contact carrier showing the details of construction;

FIG. 13 is an enlarged view of a portion of the contact carrier taken in the direction 13—13 in FIG. 12 showing the details of construction;

DETAILED DESCRIPTION OF THE PREFERRED EMBODIMENT

Figure 14:
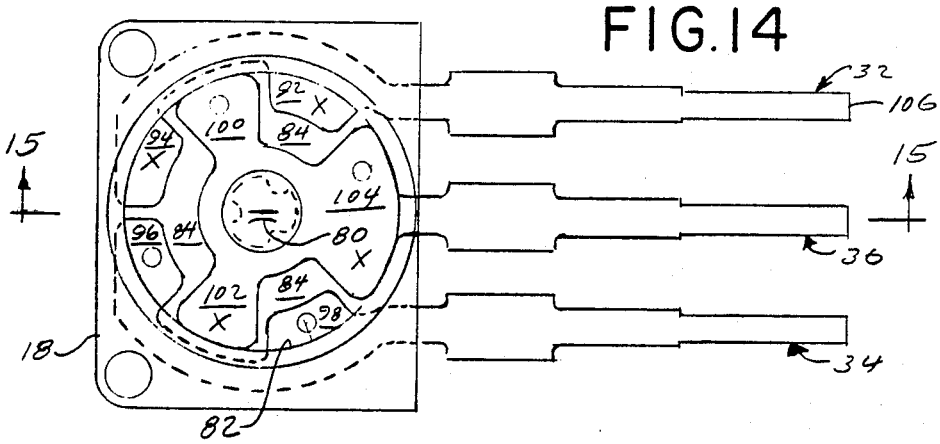
FIG. 14 is a top view of a stationary contact portion of the switch housing showing the details of construction and the arrangement of the stationary contacts and the switching action.

Shown in FIGS. 1,2 and 3 is an index rotary switch 10. As described more fully hereinbelow, the switch according to the invention is adapted for mounting directly upon a printed circuit board 12, as shown in FIG. 2, or for accepting a male plug type terminal connector 14, as shown in FIG. 3.

The switch is particularly adapted for use in low voltage automotive type applications, however, it is to be understood that it is not limited to such applications.

The switch 10 comprises four major components including: first, an electrically insulative housing made up of an actuator housing portion 16, a stationary contact housing portion 18 and a bottom or enclosure portion 20; second, a pushbutton actuated indexing rotary actuator mechanism made up of a pushbutton 22, an actuator cam follower 24, and an actuator return spring 26; third, a rotary contact mechanism made up of a rotary contact carrier 28 and a rotary electrical contact element 30; and fourth, a stationary electrical contact array made up of three electrically isolated stationary electrical contact elements 32,34, 36.

The primary object of the invention is to provide a constant pressure rotary electrical contact that is rotated to and indexed with respect to stationary electrical contacts in a sequence defining an infinite number of switch ON-OFF positions. Preferably, the rotary index motion is effected by means of a pushbutton actuated motion translating mechanism that converts linear motion of a pushbutton to rotary motion of a rotary contact. To effect this motion translation, the switch utilizes an actuator mechanism of the type commonly used in ball point pens. Such actuators, when used in writing instruments, are concerned only with extending and retracting a pen tip and not with effecting a rotary motion. It so happens, however, that at least one such actuator mechanism also imparts an index type rotary motion which can advantageously be used within an electrical switch so as to sequentially rotate a contact for indexing with stationary electrical contacts. Accordingly, the description in regard to the particular index rotary actuator mechanism is representative of only one design and is for the purpose of describing a preferred actuator found to be particularly adaptable for use within a rotary switch.

Referring to FIGS. 4–8, the actuator mechanism includes a plurality of axially extending pushbutton guides 38 equally spaced around the surface of a cylindrical pushbutton passage 40 provided in the actuator portion 16 of the housing. In the embodiment shown, the push button guides 38 are located at 45 degree positions around the passage 40. Adjacent guides accordingly form an equal number (8) of guide recesses 42 around the passage 40. As shown in FIG. 4, the lower or internal end of each guide 38 includes a cam surface 39 angularly orientated relative to the longitudinal axis of the passage 40. In the embodiment shown, the cam surfaces 39 are disposed at a 45 degree angle.

A pushbutton 22 includes four projections, only three of which 46, 47, 49 are shown in FIGS. 5 and 6, equally spaced around its outer periphery which are slidably received within the guide recesses 42 and accordingly axially guide the pushbutton for linear motion within the passageway 40. There need not be a projection received within each recess. One projection would suffice since its function is to axially guide the pushbutton within the housing passage 40.

Referring to FIG. 5, the lower or internal end of the pushbutton 22 is provided with a plurality of angularly disposed cam surfaces 48 forming a saw tooth configured end. In particular, there are eight triangular teeth 50 equally spaced at 45 degree intervals around the periphery of the internal end of the pushbutton. As shown in FIG. 6, the pushbutton 22 is provided with an internal cylindrical cavity 52 into which an actuator cam follower 24, shown in FIGS. 7, 8, and 9 is slidably received. The actuator cam follower 24 is also free to rotate within the cavity 52. As shown in FIG. 7, the actuator cam follower 24 is provided with a plurality of angularly disposed adjacent cam surfaces 51,53 forming a plurality of upwardly directed, as viewed in FIG. 7, triangular shaped teeth 56 equal in number to that of the teeth 50 upon the pushbutton. In the embodiment shown, the cam follower accordingly includes eight triangular teeth disposed at 45 degree positions around the periphery of the cam follower 24 which face the teeth 50 upon the pushbutton. The cam follower also includes four longitudinal guides 58,59,61,63 projecting radially outwardly from its periphery. Each guide includes one of the cam surfaces 53 and accordingly forms one side of four of the teeth 56. The guides 58, 59, 61, 63 are received within the longitudinal guide recesses 42 provided within the passage 40. The cam follower, as noted, is slidably received within the cavity 52 of the pushbutton with its teeth 56 received within the spaces between the teeth 50 formed upon the end of the pushbutton with the cam surfaces 51, 53 abutting against the cam surfaces 48 of the pushbutton. As noted, the longitudinal guides 58,59,61,63 upon the cam follower are received within the longitudinal guide recesses 42 of the housing portion 16.

Figure 16A:
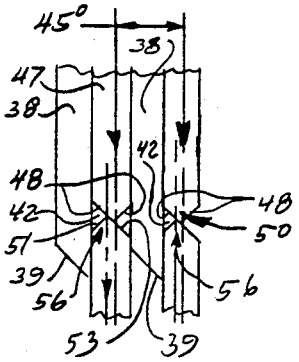
FIGS. 16A, B,C,D,E comprise a sequential diagrammatic representation showing the operation of the pushbutton actuator mechanism.
Figure 16B:
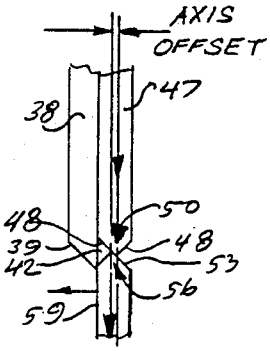

As shown best in FIGS. 16A and 16B, with the cam follower assembled within the pushbutton and that assembly disposed within the passage 40 of the actuator housing 16 as described above, the axis through the apex of the teeth 56 upon the cam follower are offset from the axis through the apex of the teeth 50 upon the pushbutton. Accordingly, as the pushbutton is depressed so as to move the pushbutton and cam follower downwardly as viewed in the drawings, a lateral force, as indicated by means of the arrow pointing to the left in FIG. 16B is imparted to the cam follower 24 due to the offset axes and angularly disposed butting cam surfaces 48,53. Complete operation of the actuator is described below in connection with the operation of the switch.

Referring to FIGS. 8 and 9, the actuator cam follower 24 includes a square shaped internal cavity 60 that is angularly orientated, as shown in FIG. 9, so as to orientate a plurality of rotary contacts, described below, relative to an array of stationary contacts, also described below, such that the rotary contacts will index with the stationary contact array in an ON and OFF timing relationship with successive actuations of the actuator.

Referring to FIGS. 10, 11 and 12, the rotary contact carrier 28 has a square shaped stem 64 slidably received within the square cavity 60 of the actuator cam follower. It can be seen that the cam follower is free to move linearly over the stem 64 and the square configuration provides for engagement of the contact carrier 28 with the cam follower so that the cam follower will rotate the carrier as it rotates. The contact carrier 28 is preferably provided with a tapered twisted end 63 which functions as a pilot for automatically indexing the square stem with the square cavity during assembly. The contact carrier is provided with a spring seat 66 against which one end of the actuator return spring 26 is supported. The opposite end of the return spring 26 is supported against the lower end of the actuator cam follower. The return spring 26 accordingly biases the cam follower teeth into engagement with the teeth of the pushbutton with the pushbutton stop surface 70 biased against the stop shoulder 72 on the actuator portion 16 of the housing in its released position.

The upper side of the contact carrier 28, that is the side facing the actuator portion 16 of the housing, is provided with a thrust bearing surface 74 that engages a thrust bearing surface 76 provided upon an inner surface of the actuator portion 16 of the housing around the pushbutton actuator passage 40. A second thrust bearing is provided between the opposite end of the contact carrier and a bottom surface of the stationary contact portion 18 of the housing.

The second thrust bearing is formed by means of a spheroidal recess 78 centrally formed within the stationary contact side of contact carrier within which a corresponding spheroidal projection 80 provided upon the stationary contact portion of the housing is received. Accordingly, the contact carrier is axially supported between the two thrust bearings against axial movement and is journaled solely for rotary motion.

Figure 15:
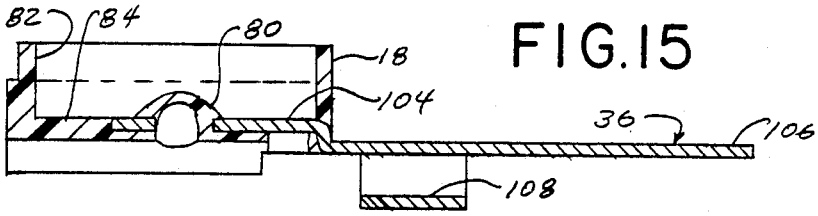
FIG. 15 is a cross sectional view through the stationary contact portion of the housing taken along the line 15—15 in FIG. 14.

The stationary contact portion 18 of the housing is shown in FIGS. 14, and 15. The housing portion 18 is molded so as to include a shallow cylindrical recess 82 having a substantially flat bottom surface 84 with the spheroidal thrust bearing surface 80 centrally located upon the recess bottom surface 84. Molded into the stationary contact portion 18 of the housing are preferably three stationary electrically isolated electrical contact elements 32,34,36. The stationary contact elements include a plurality of co-planar stationary contacts disposed in a co-planar manner with respect to the bottom surface 84 of the recess 82. Specifically, the stationary contact element 32 includes two electrically connected co-planar contacts 92, 94 spaced apart 90 degrees. The stationary contact element 34 also includes two electrically connected co-planar contacts 96, 98 spaced apart 90 degrees. The stationary contact pairs 92, 94, and 96, 98 are electrically isolated with respect to each other and are located generally around the outer periphery of the recess 82 so as to define an infinite number of alternating ON-OFF positions as explained below. The center stationary contact element 36 includes three additional electrically connected co-planar contacts, 100,102, 104. One contact 100 is located between the two electrically connected contacts 92, 94 of the contact element 32 and the second contact 102 is located between the contacts 96,98 of the second stationary contact element 34. The third contact 104 of the third stationary contact element is located between the two electrically isolated contacts 92, 98 of the first and second contact elements. The three additional contacts 100, 102, 104 are accordingly located approximately 120 degrees apart with the contact 104 occupying an arc approximately 90 degrees.

As shown in FIG. 15, each stationary contact element 32,34,36 includes a combination printed circuit board mounting terminal spade 106 and a female plug receptacle 108, thereby providing for alternative electrical connections to a variety of popular applications.

Referring principally to FIGS. 12 and 13, the contact carrier 28 includes a generally circular rotary electrical contact element 30 molded therein. The contact element 30 includes four electrically connected equally spaced apart resilient contact arms 112, 114,116, 118 each cantilevered from the contact carrier and being curved so as to define a generally circular outer perimeter for the rotary contact element for receipt within the circular recess 82. Each contact arm is preformed so as to be deformed out from a plane lying perpendicular to the longitudinal axis of the contact element, as shown in FIG. 13, such that when the contact element is positioned within the recess 82 of the stationary contact portion of the housing with the carrier journaled between the thrust bearings, a predetermined bias or load is imposed between the recess bottom and the stationary contacts and each rotary contact 86,88,90,91 provided at the free end of each rotary contact arm 112,114,116,118. The contact loading accordingly is due to the resiliency of the contact arms and the degree of deflection when formed and is independent of the any load imposed upon the contact carrier by means of the pushbutton return spring 26. The load placed upon the contact carrier by means of the pushbutton return spring is supported by means of the spheroidal thrust bearing 78,80 and thus is isolated from and not imposed upon the rotary contact arms 112,114,116,118. Accordingly, the load upon the rotary contacts 86,88,90,91 remains substantially constant throughout the life of the switch and is not affected by means of the operation of the pushbutton. As shown in FIG. 13 each rotary contact 86,88,90,91 includes an arcuate shaped contact configuration that wipingly sweeps across the recess bottom surface 84 into and out of contact with the stationary contacts and substantially eliminates arcing and helps keep the contacts clean as the rotary and stationary contacts make and break contact with respect to each other.

Operation of the switch and the electrical connections effected will be understood from the following description with reference particularly to FIG. 14 and FIGS. 16A–16E. First, the stationary contact element 36 is connected to an external power source and the switching action effects alternately connecting and disconnecting the stationary contact elements 32, 34 with the contact element 36 with each successive actuation of the actuator. The stationary contact elements 32,34, are connected to the auxiliary equipment to be controlled by means of the switch.

In FIG. 14, the Xs and Os designate successive positions assumed by means of the four rotary contacts 86,88,90,91 with each actuation of the pushbutton. Beginning with the four rotary contacts 86,88,90, 91 disposed at the positions designated X, it can be seen that the two stationary contacts 92, 94 will be electrically connected by means of the rotary contact element to the two diametrically opposite stationary contacts 102, and 104. Thus the contact element 36 will be electrically connected to the contact element 32, whereas the contact element 34 is electrically isolated from the contact element 36. When the switch is actuated by pushing and releasing the pushbutton, the rotary index actuator (The operation of which is shown in FIGS. 16A–16E and will be described immediately below) causes the rotary contact carrier 28 to rotate such that the four rotary contacts 86,88,90,91 index with respect to the stationary contacts so as to be disposed at the positions by the O. In this position, the contacts 100 and 104 of the contact element 36 are electrically connected to the stationary contacts 96,98 of the contact element 34 thus electrically connecting the contact element 34 to the contact element 36. Simultaneously the contact element 32 is electrically isolated from the contact element 36. It can be seen that with each successive actuation, the rotary contact progressively moves 45 degrees and alternately indexes with respect to the stationary contacts of the respective elements 32, 34, and alternately switches the elements 32,34 ON and OFF.

A very important advantage of this structure is that in each ON position there are always two rotary contacts and two stationary contacts electrically connected together providing for doubling of the contact area and current carrying capacity of the switch as compared with a single contact connection.

Figure 16C:
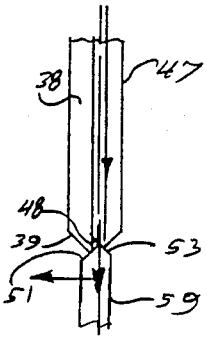
Figure 16D:
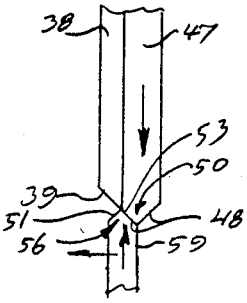
Figure 16E:
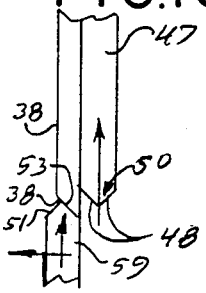

Regarding the operation of the actuator mechanism, FIGS. 16A–16E show the operation of only one segment of the actuator. The teeth, guides and cam surfaces of the remaining segments all function simultaneously with and the same as that described. FIG. 16A shows the pushbutton released and just beginning a downward stroke to rotate the contact carrier. The teeth 56 on the cam follower are disposed against the teeth 50 upon the pushbutton. As the pushbutton moves downwardly, the cam follower is also forced downwardly by means of the pushbutton against the opposing force of the return spring 26 until, as shown in FIG. 16B, the cam surface 51 upon the cam follower reaches the bottom of the guide member 38 upon the passage 40 wall. Continued depression of the pushbutton, as shown in FIG. 16C, causes the cam follower to begin to rotate, as indicated by means of the leftward pointing arrow in FIG. 16C. The rotation is caused by means of the offset longitudinal axes of the push button and cam follower teeth and the abutting angular cam surfaces 53 and 48 upon the cam follower and pushbutton. The cam follower continues to be displaced laterally until, at the fully depressed position of the pushbutton, as shown in FIG. 16D, the apex of the tooth 56 upon the cam follower moves into engagement with the cam surface 39 upon the bottom of the guide 38. When the pushbutton is released, as shown in FIG. 16E the force of the return spring 26 acts upon the follower in an upward direction, as viewed in the drawing, whereupon the cam surface 53 of the cam follower rides over the cam surface 39 of the guide 38 so as to further rotate the follower until each guide projection 58,59,61,63 clears the guides 38 and are positioned within the next guide recess 42 disposed upon the opposite side of each of the respective guides 38. Since each guide recess 42 is disposed 45 degrees apart, each successive positioning of the cam follower moves the cam follower and the contact carrier connected thereto 45 degrees, thus indexing the rotary contacts with respect to the stationary contact array so as to effect the ON-OFF switching action.

Having described the preferred embodiment of the invention, those skilled in the art can readily devise other embodiments and modifications and such other embodiments and modifications are to be considered to be within the scope of the appended claims.

What is claimed is:

1. An index rotary switch, comprising:

an electrically insulative housing;

first stationary contact means fixedly mounted within said housing for defining part of a first control circuit;

second stationary contact means fixedly mounted within said housing for defining part of a second control circuit and electrically isolated from said first stationary contact means;

third stationary contact means fixedly mounted within said housing, and electrically isolated from said first and second stationary contact means, for alternatively cooperating with said first and second stationary contact means so as to alternatively define said first and second control circuits;

rotary contact means rotatably mounted within said housing for alternatively interconnecting said first and third stationary contact means and said second and third stationary contact means so as to alternatively complete said first and second control circuits; and pushbutton-operated actuator means mounted within said housing and operatively connected to said rotary contact means for sequentially rotating and indexing said rotary contact means between predetermined rotary positions at which said rotary contact means alternatively interconnects said first and third stationary contact means, and said second and third stationary contact means, so as to alternatively complete said first and second control circuits upon successive actuations of said pushbutton-operated actuator means.

2. An index rotary switch as set forth in claim 1, further comprising:

means for providing constant loading between said rotary contact means and said first, second, and third stationary contact means.

3. The index rotary switch as defined in claim 2, wherein:

said means for providing constant loading includes a rotary contact carrier mounted by thrust bearing means associated with said housing and said rotary contact carrier for preventing axial movement of said rotary contact carrier; and said rotary contact means includes a preformed resilient contact element mounted upon said rotary contact carrier and disposed against said first, second, and third stationary contact means.

4. The index rotary switch as defined in claim 3, further including:

terminal means electrically connected to said first, second, and third stationary contact means so as to be adapted to electrically connect said first, second, and third stationary contact means to external circuit means.

5. The index rotary switch as defined in claim 4 wherein said terminal means is adapted to be mounted upon a printed circuit board.

6. The index rotary switch as defined in claim 4 wherein said terminal means is a female plug receptacle adapted to receive a male terminal plug.

7. The index rotary switch as defined in claim 4 wherein said terminal means is a combination lug for mounting upon a printed circuit board and a female plug receptacle adapted to receive a male terminal plug.

8. An index rotary switch, comprising:

a housing including a first pushbutton-operated actuator portion, having a cylindrical passage defined therein; and a second stationary contact portion secured to said first pushbutton-operated actuator portion;

at least two stationary contact elements disposed within said second stationary contact portion of said housing and including a plurality of substantially co-planar stationary contacts arranged in a substantially circular, spaced-apart relationship so as to define an infinite number of alternating ON and OFF positions;

a first thrust bearing surface defined upon said first pushbutton actuator housing portion;

a second thrust bearing surface defined upon said second stationary contact housing portion;

a rotary contact carrier rotatably journaled within said second stationary contact housing portion about a rotary axis thereof;

third and fourth thrust bearing surfaces defined upon said rotary contact carrier for engagingly cooperating with said first and second thrust surfaces of said first and second housing portions so as to axially support said rotary contact carrier within said housing and prevent axial displacement of said rotary contact carrier within said housing;

a rotary contact element mounted upon said rotary contact carrier and including at least two electrically connected resilient contact portions preformed so as to exert a predetermined contact pressure upon said plurality of stationary contacts, and angularly spaced apart such that each one of said resilient contact portions wipingly contacts different ones of said stationary contacts at least in said ON position; and pushbutton-operated actuator means movably disposed within said cylindrical passage of said first pushbutton-operated actuator portion of said housing for sequentially rotating said rotary contact carrier such that said resilient contact portions of said rotary contact element alternately index to said ON and OFF positions upon successive actuations of said pushbutton-operated actuator means.

9. The index rotary switch as defined in claim 8 wherein said at least two resilient contact portions comprise generally elongated arms cantilevered from said rotary contact carrier and predeflected from said contact carrier a predetermined amount such that said resilient contact portions exert a constant load on said stationary contact elements when mounted between said first and second thrust bearing surfaces.

10. The index rotary switch as defined in claim 9 wherein said second thrust bearing surface comprises a raised substantially spheroidal projection defined upon said second portion of said housing, said spheroidal projection being disposed against said rotary contact carrier and received within a complementary shaped spheroidal shaped receptacle centrally located in one surface of said rotary contact carrier.

11. The index rotary switch as defined in claim 10 wherein said elongated arms defining said at least two resilient contact portions define a circular periphery with respect to said axis of said rotary contact element, said second portion of said housing including a cylindrical recess coaxial with said cylindrical passage in said actuator portion of said housing and said recess having a flat bottom surface, co-planar with said stationary contacts, said spheroidal projection disposed centrally on said bottom surface, said rotary contact carrier disposed in said cylindrical recess, whereby said contact arms wipingly engage said stationary contacts with constant load.

12. The index rotary switch as defined in claim 8 wherein each of said at least two stationary contact elements includes terminal connections for connecting directly to an external printed circuit board.

13. The index rotary switch as defined in claim 8 wherein each of said at least two stationary contact elements includes a female plug terminal receptacle.

14. The index rotary switch as defined in claim 8 wherein each of said at least two stationary contact elements includes a combination female plug terminal receptacle and a printed circuit board connection.

15. An index rotary switch comprising:

an electrically insulative housing;

a first stationary contact element in said housing including two electrically connected co-planar angularly spaced apart contacts;

a second stationary contact element in said housing including two electrically connected co-planar angularly spaced apart contacts, said second stationary contact element electrically isolated from said first stationary contact element;

a third stationary contact element in said housing including three electrically connected co-planar spaced apart contacts, one of said three contacts of said third stationary contact element disposed between said two contacts of said first stationary contact element, a second of said three contacts of said third stationary contact element disposed between said two contacts of said second stationary contact element, and a third of said three contacts of said third stationary contacted element disposed between one of each of said two contacts of said first stationary contact element and said second stationary contact element, said third stationary contact element electrically isolated from said first and said second stationary contact elements;

a rotary contact carrier mounted for rotation in said housing between two thrust bearing means;

a rotary contact element mounted to said rotary contact carrier including four contacts located at positions on said rotary contact carrier such that two of said four contacts of said rotary contact element simultaneously contact both of said two contacts of one of said first or second stationary contact elements and the two other of said four contacts of said rotary contact element simultaneously contact two of said three contacts of said third stationary contact element in each of an infinite number of on-off positions of said rotary contact carrier; and pushbutton operated actuator means for successively rotating and indexing said rotary contact carrier to each of said on-off positions upon successive actuations of said pushbutton-operated activator means.

16. The index rotary switch as defined in claim 15 wherein said two thrust bearing means includes two thrust bearing surfaces on said housing engaged by opposite sides of said contact carrier.

17. The index rotary switch as defined in claim 16 wherein said housing includes an internal cylindrical recess, said stationary contacts disposed in a bottom surface of said recess co-planar with said bottom surface, one of said thrust bearing surfaces disposed on said bottom surface, the second thrust bearing surface disposed on said housing around a cylindrical passage connecting co-axially with said cylindrical recess, said rotary contact carrier disposed in said cylindrical recess between said first and second thrust bearing surfaces with said four rotary contacts wipingly engagable with said stationary contacts.

18. The index rotary switch as defined in claim 17 wherein each of said four contacts of said rotary contact element is a resilient member cantilevered from said rotary contact carrier and preformed to impose a predetermined load on said stationary contacts.

19. The index rotary switch as defined in claim 18 wherein said housing comprises:

an actuator portion including said cylindrical passage, said pushbutton operated actuator means mounted in said cylindrical passage; and a stationary contact terminal portion including said cylindrical recess, said first, second and third stationary contact elements mounted in said contact terminal portion.

20. The index rotary switch as defined in claim 19 wherein each of said first, second and third stationary contact elements include a combination printed circuit board mounting terminal and female plug terminal receptacle.

* * * * *